US005090106A

United States Patent [19]

Fink

[11] Patent Number: 5,090,106

[45] Date of Patent: Feb. 25, 1992

[54] METHOD OF MANUFACTURING A SCORING BOARD

[76] Inventor: David F. Fink, 17665 Bayberry Dr., Spring Lane, Mich. 49456

[21] Appl. No.: 674,613

[22] Filed: Mar. 25, 1991

[51] Int. Cl.[5] ..... B23P 19/02

[52] U.S. Cl. ..... 29/525; 29/525.1

[58] Field of Search ..... 235/90; 29/525.1, 525.2, 29/525; 227/51

[56] References Cited

U.S. PATENT DOCUMENTS

| | | | |
|---|---|---|---|
| 1,717,037 | 6/1929 | Kallio | 235/90 |
| 2,594,943 | 4/1952 | Logan | 235/90 |
| 2,759,082 | 8/1956 | Rea | 29/525.2 X |
| 2,952,461 | 9/1960 | Boulanger | 235/90 X |
| 3,276,308 | 10/1966 | Bergere | 29/525.2 X |
| 4,195,767 | 4/1980 | Harden | 235/90 |
| 4,332,386 | 6/1982 | Townsend | 235/90 X |
| 4,450,615 | 5/1984 | Pickios | 29/525.2 X |

*Primary Examiner*—Timothy V. Eley
*Assistant Examiner*—C. Richard Martin
*Attorney, Agent, or Firm*—Waters & Morse

[57] ABSTRACT

A scoring board is manufactured by modifying standard blind rivets so that the headed shafts are removed, inverted, and trimmed to provide scoring pegs. The usual tubular sleeve of the blind rivet becomes an insert in enlarged holes in the body of the board. These freely receive the pegs to provide wear-proof receptacles for pegs that are enconomically manufactured by a process relating to nail forging.

1 Claim, 1 Drawing Sheet

METHOD OF MANUFACTURING A SCORING BOARD

BACKGROUND OF THE INVENTION

An endless variety of games can be played with a standard or special deck of cards, and many of them usually have the score recorded on peg boards as the game proceeds. Parallel rows of holes are engaged by pegs associated with each player, and the pegs are advanced with each step in the game sequence. Cribbage and Euchre are popular examples, and the number of boards in use is well into the millions.

The usual construction of these scoring boards involves the use of specialized automated woodworking techniques to produce boards of good finish and cleanly machined holes. Special pegs are commonly made as screw-machine items out of brass or aluminum. Extended use of a board and its set of pegs has a tendency to distort the holes and interfere with the clean alignment of the engaged pegs. The present invention is directed at the reduction of the cost to manufacture, and the elimination of the effects of wear.

SUMMARY OF THE INVENTION

Standard blind rivets are modified slightly, and are put to a use totally different from that for which they were originally designed. These rivets are usually of an aluminum alloy, and normally consist of a tubular sleeve traversed by a headed shaft having the appearance of a finishing nail. The head will not pas freely through the sleeve, and a severe pull on the shaft from the opposite end emerging from the sleeve expands the sleeve as the head attempts to enter it. The pull normally continues until the shaft snaps off just beyond the head at a weakened point provided for this purpose.

This standard fastener is modified for the purpose of the present invention by removing the headed shaft and This standard fastener is modified for the purpose of the present invention by removing the headed shaft and usually cutting off part of the end opposite from the head. This becomes one of the pegs, with the headed end acting as a convenient grasping point when the shaft is inverted from its original position. The holes in the board are sized to receive the outside diameter of the sleeves in a close fit, so that the sleeves become metal liners for the holes engaged by the pegs. Some blind rivets are of steel, but it is preferable to use materials for the present invention that do not corrode or seriously tarnish. The usual blind rivet has a flange at one end of the sleeve that provides an enlarged area of protection to the board against inaccurate attempts to engage the pegs. The net effect of this system is to eliminate the cost of the special lathe-turned pegs, and establish wear-proof receptacles for them on the board. The pegs become items made on a forging machine similar to that used to convert coils of wire into nails. This operation is much faster and less expensive than the screw-machine operation.

DESCRIPTION OF THE PREFERRED EMBODIMENT

Figure 1:
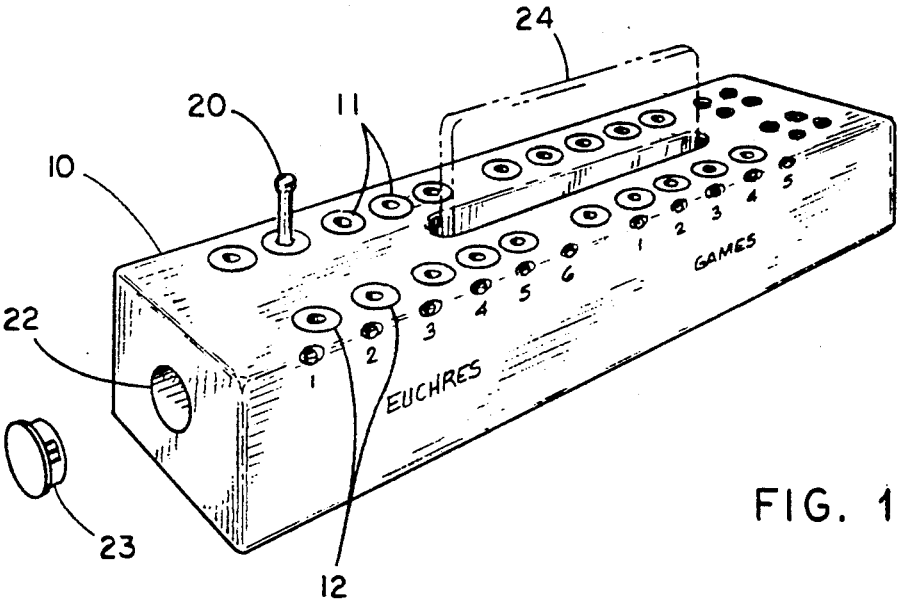
FIG. 1 is a perspective view of a scoring board incorporating the present invention.
Figure 2:
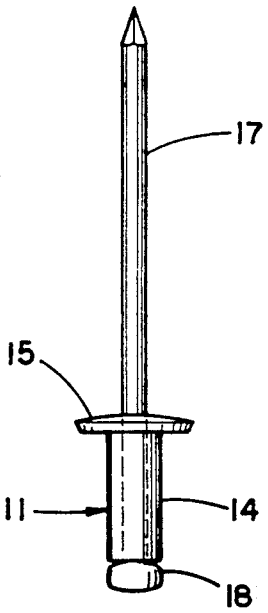
FIG. 2 is a side elevation on an enlarged scale of a standard blind rivet before it is modified for the purposes of the present invention.
Figure 4:
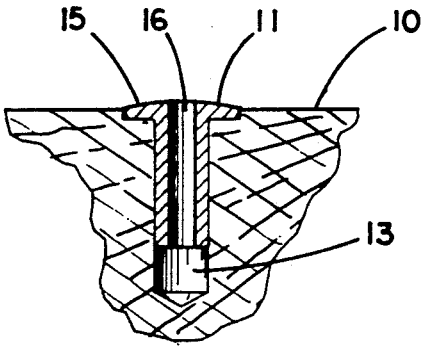
FIG. 4 is a section through the board at one of the holes, with the sleeve portion of the blind rivet assembly installed in the board and in condition to receive the peg of FIG. 3.

Referring to FIG. 1, the illustrated board is formed from a block of wood 10 having parallel rows of holes occupied by the sleeve elements 11 and 12 of standard blind rivets of the type shown in FIG. 2. These are installed in the board in the relationship shown in FIG. 4. Holes 13 are drilled in the board 10 of about the same diameter as the outside of the tubular portion 14 of the sleeve elements, resulting in a light press fit. These holes are then counterbored at the surface of the board to receive the flanges 15 of the sleeve elements flush with the surface of the board.

Figure 3:
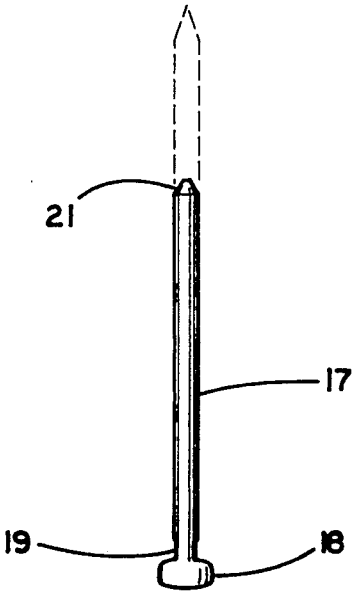
FIG. 3 is a side elevation showing a peg as a modified form of the shaft of the blind rivet assembly appearing in FIG. 2.

The axial holes 16 in the sleeve elements freely receive the shanks 17 of the standard shafts of the blind rivet assembly shown in FIG. 2. The heads 18 of these shafts will not freely enter the tubular portions 14; but on a severe pull from above, as viewed in FIG. 2, the shaft 17 would pull the head 18 slightly into the end of the tubular portion 14, causing it to expand and function as a rivet to secure two pieces together that have been traversed by the tubular section 14. The pull is normally continued until the pin fractures at the weakened portion 19 shown in FIG. 3. This is the usual function of a blind rivet. The shaft 17 is removed from the sleeve portion for the present invention by a relatively light shove downward, as viewed in FIG. 2, and is then cut off to the desired length shown in FIG. 3 to function as a scoring peg. The head 18 forms a convenient handle or grasping point when the peg is inverted into the position shown in FIG. 1 at 20. Preferably, the ends of the pegs are bevelled as shown at 21 in FIG. 3 to facilitate insertion into the assembled board.

It is preferable that the board be provided with a storage recess similar to that shown at 22 in FIG. 1 for receiving an appropriate number of pegs during periods in which the board is not in use. These recesses will normally be closed by the cap 23. It is also preferable that the board be provided with a slot in its top surface for receiving a group of cards indicated in dotted lines a 24. Other rows of holes in the block 10 may be provided for various scoring purposes. These may be with or without the linings formed by the tubular sections of blind rivets.

I claim:

1. A method of manufacturing a scoring board having a plurality of peg-receiving holes, said method comprising:

selecting a group of blind rivets each having a tubular portion, and also a shaft member provided with an enlarged head, said shaft member initially traversing said tubular portion up to said head, said head having a diameter exceeding the inside diameter of said tubular portion;

forming a group of holes in a block of material, said holes being adapted to closely receive the outside diameter of said tubular portion; and removing said shaft members from said tubular portion, and subsequently engaging said tubular portions with said holes, respectively.

* * * * *

UNITED STATES PATENT AND TRADEMARK OFFICE

CERTIFICATE OF CORRECTION

PATENT NO. : 5,090,106

DATED : February 25, 1992

INVENTOR(S) : David F. Fink

It is certified that error appears in the above-identified patent and that said Letters Patent is hereby corrected as shown below:

On the title page, item (76) should read:

--Inventor: David F. Fink, 17665 Bayberry Dr., Spring Lake, MI 49456--.

Signed and Sealed this

Fourth Day of May, 1993

Michael K. Kirk

MICHAEL K. KIRK

*Acting Commissioner of Patents and Trademarks*

*Attest:*

*Attesting Officer*